US005743798A

United States Patent [19]

Adams et al.

[11] Patent Number: 5,743,798

[45] Date of Patent: Apr. 28, 1998

[54] APPARATUS FOR PLAYING A ROULETTE GAME INCLUDING A PROGRESSIVE JACKPOT

[75] Inventors: Terry Allen Adams, Coconut Creek; Yosef Har-Nov, Margat; Donald W. Jones, Parkland, all of Fla.; Peter R. De Raedt, Wijnegem, Belgium; Jeremy Francisco Stein, Wilton Manors, Fla.; Jonathan Charles West, San Diego, Calif.; Michael Wade Woodruff, Ft. Lauderdale, Fla.

[73] Assignee: Progressive Games, Inc., Ft. Lauderdale, Fla.

[21] Appl. No.: 724,535

[22] Filed: Sep. 30, 1996

[51] Int. Cl.[6] ..... A63F 5/02

[52] U.S. Cl. ..... 463/17; 463/27; 273/309; 273/274; 273/142 B; 273/142 E

[58] Field of Search ..... 463/17, 27, 26, 463/12, 13; 273/292, 309, 274, 138.1, 138.2, 142 E, 142 B

[56] References Cited

U.S. PATENT DOCUMENTS

| | | |
|---|---|---|
| D. 105,610 | 8/1937 | Posey . |
| D. 118,451 | 8/1940 | Radford . |
| D. 183,007 | 6/1958 | Lord . |
| D. 213,891 | 4/1969 | Schultz . |
| D. 220,635 | 5/1971 | Boyer et al. . |
| D. 245,717 | 9/1977 | Jessie . |
| D. 263,975 | 4/1982 | Quiroga et al. . |
| D. 311,474 | 10/1990 | Hoffman . |
| 1,238,736 | 9/1917 | Barrett . |
| 1,527,929 | 6/1925 | Simons . |
| 1,763,476 | 6/1930 | Morris . |

(List continued on next page.)

FOREIGN PATENT DOCUMENTS

| | | |
|---|---|---|
| 621599 | 4/1989 | Australia . |
| 628044 | 4/1989 | Australia . |
| 96049 | 4/1989 | Austria . |
| 1334983 | 3/1995 | Canada . |
| 1335381 | 4/1995 | Canada . |

(List continued on next page.)

OTHER PUBLICATIONS

Winning Gamer, Issue #5, Feb. 1985, Pi Yee Press, LaJolla, CA.

Winning Gamer, Issue #6, Mar. 1985, Pi Yee Press, LaJolla, CA.

Winning Gamer, Issue #15, Dec. 1985, Pi Yee Press, LaJolla, CA.

Winning Gamer, Issue #19, Apr. 1986, Pi Yee Press, LaJolla, CA.

Winning Gamer, Issue #20, May 1986, Pi Yee Press, LaJolla, CA.

(List continued on next page.)

*Primary Examiner*—Benjamin H. Layno

[57] ABSTRACT

A roulette game including a progressive jackpot includes a plurality of coin acceptors to enable players to place an optional progressive jackpot wager. Players place game wagers on a numbered layout imprinted on a table surface by using different colored chips assigned to each player. A control system includes an optical sensor head for detecting the speed and position of the ball in the roulette wheel, as well as the number of revolutions of the wheel. The control system displays on an electronic sign a progressive jackpot amount, winning numbers, and a random bonus jackpot. Players win the progressive jackpot by betting on the same winning number four times in a row. The electronic control system of the game, in conjunction with a dealer console, maintains an accounting of wagers placed, winning numbers, and amounts paid. The apparatus also includes a sound system for generating various sound effects at different stages of the game to enhance player excitement and appeal. A motorized chip conveyer assembly disposed beneath the table surface forms a chip return track underlying the coin acceptors for the purpose of returning chips or tokens placed as jackpot wagers to the dealer.

8 Claims, 4 Drawing Sheets

U.S. PATENT DOCUMENTS

| | | | |
|---|---|---|---|
| 1,970,876 | 4/1934 | Anderson . | |
| 2,008,829 | 10/1935 | Israel . | |
| 2,199,745 | 5/1940 | Harris . | |
| 3,011,789 | 12/1961 | Eliassen et al. . | |
| 3,269,503 | 8/1966 | Foster . | |
| 3,556,531 | 1/1971 | Elder . | |
| 3,663,021 | 5/1972 | Whippo . | |
| 3,667,757 | 6/1972 | Holmberg . | |
| 3,689,071 | 9/1972 | Kucera . | |
| 3,796,433 | 3/1974 | Fraley et al. . | |
| 3,825,255 | 7/1974 | Kennaro et al. . | |
| 3,874,671 | 4/1975 | Smith . | |
| 3,876,208 | 4/1975 | Wachtler et al. . | |
| 3,998,462 | 12/1976 | Goott . | |
| 4,063,680 | 12/1977 | Leo . | |
| 4,078,405 | 3/1978 | Jones et al. . | |
| 4,099,722 | 7/1978 | Rooesch et al. . | |
| 4,232,866 | 11/1980 | Pennachio . | |
| 4,302,012 | 11/1981 | Di Giovanni et al. . | |
| 4,305,586 | 12/1981 | Richards . | |
| 4,364,567 | 12/1982 | Goott . | |
| 4,397,469 | 8/1983 | Carter, III . | |
| 4,518,001 | 5/1985 | Branham . | |
| 4,531,187 | 7/1985 | Uhland . | |
| 4,575,085 | 3/1986 | Ollington . | |
| 4,614,342 | 9/1986 | Takashima . | |
| 4,624,459 | 11/1986 | Kaufman . | |
| 4,648,604 | 3/1987 | Horan . | |
| 4,651,997 | 3/1987 | Wood . | |
| 4,700,948 | 10/1987 | Okada . | |
| 4,721,307 | 1/1988 | Okada . | |
| 4,743,022 | 5/1988 | Wood . | |
| 4,756,531 | 7/1988 | DiRe et al. . | |
| 4,759,549 | 7/1988 | Beckwith . | |
| 4,760,527 | 7/1988 | Sidley . | |
| 4,813,675 | 3/1989 | Greenwood . | |
| 4,836,546 | 6/1989 | DiRe et al. . | |
| 4,836,553 | 6/1989 | Suttle et al. . | |
| 4,837,728 | 6/1989 | Barrie et al. . | |
| 4,861,041 | 8/1989 | Jones et al. . | |
| 4,948,134 | 8/1990 | Suttle et al. . | |
| 4,964,638 | 10/1990 | Ishida . | |
| 5,007,519 | 4/1991 | Mercurio . | |
| 5,019,973 | 5/1991 | Wilcox et al. . | |
| 5,022,653 | 6/1991 | Suttle et al. . | |
| 5,042,810 | 8/1991 | Williams | 463/17 |
| 5,042,818 | 8/1991 | Weingardt . | |
| 5,048,833 | 9/1991 | Lamle | 463/27 |
| 5,078,405 | 1/1992 | Jones et al. . | |
| 5,098,107 | 3/1992 | Boylan et al. . | |
| 5,100,137 | 3/1992 | Fulton . | |
| 5,112,060 | 5/1992 | Jones | 273/309 |
| 5,154,429 | 10/1992 | Lavasseur . | |
| 5,167,413 | 12/1992 | Fulton . | |
| 5,248,142 | 9/1993 | Breeding . | |
| 5,249,800 | 10/1993 | Hilgendorft et al. . | |
| 5,251,897 | 10/1993 | Fulton . | |
| 5,257,810 | 11/1993 | Schorr et al. . | |
| 5,275,400 | 1/1994 | Weingardt et al. . | |
| 5,275,411 | 1/1994 | Breeding . | |
| 5,275,415 | 1/1994 | Wisted . | |
| 5,277,424 | 1/1994 | Wilms . | |
| 5,288,077 | 2/1994 | Jones . | |
| 5,288,081 | 2/1994 | Breeding . | |
| 5,364,104 | 11/1994 | Jones et al. . | |
| 5,364,105 | 11/1994 | Jones . | |
| 5,374,067 | 12/1994 | Jones . | |
| 5,377,973 | 1/1995 | Jones . | |
| 5,377,994 | 1/1995 | Jones | 273/309 |
| 5,380,012 | 1/1995 | Jones . | |
| 5,382,025 | 1/1995 | Sklansky et al. . | |
| 5,393,067 | 2/1995 | Paulsen et al. . | |
| 5,411,257 | 5/1995 | Fulton . | |
| 5,417,430 | 5/1995 | Breeding . | |
| 5,437,462 | 8/1995 | Breeding . | |
| 5,472,194 | 12/1995 | Breeding et al. . | |
| 5,489,101 | 2/1996 | Moody . | |
| 5,570,885 | 11/1996 | Ornstein | 463/17 |
| 5,586,766 | 12/1996 | Forte et al. | 273/309 |
| 5,588,650 | 12/1996 | Eman et al. | 463/17 |

FOREIGN PATENT DOCUMENTS

| | | |
|---|---|---|
| 4792 | 6/1991 | Dominican Rep. . |
| 4793 | 6/1991 | Dominican Rep. . |
| 4825 | 3/1993 | Dominican Rep. . |
| 4999 | 8/1993 | Dominican Rep. . |
| 0338644 | 4/1989 | European Pat. Off. . |
| 2830216 | 1/1980 | Germany . |
| 3003376 | 8/1981 | Germany . |
| 68909992 | 4/1989 | Germany . |
| 0338644 | 4/1989 | Italy . |
| 135187 | 6/1988 | Japan . |
| 2083936 | 3/1982 | United Kingdom . |
| 2097570 | 4/1982 | United Kingdom . |
| 2169736 | 7/1986 | United Kingdom . |
| 2184029 | 6/1987 | United Kingdom . |
| 9220417 | 11/1992 | WIPO . |
| 9310869 | 6/1993 | WIPO . |
| 9415684 | 7/1994 | WIPO . |
| 9521665 | 8/1995 | WIPO . |

OTHER PUBLICATIONS

Winning Gamer, Issue #21, Jun. 1986, Pi Yee Press, LaJolla, CA.

Affidavit of John F. Acres, Oct. 4, 1993.

Affidavit of William Randall Adams, Oct. 4, 1993.

Affidavit of Derell M. Johns, Nov. 19, 1993.

Affidavit of Terry Oliver, Nov. 22, 1993.

Affidavit of Nick Edward Greenwood, Nov. 23, 1993.

Affidavit of Michael Spencer Stone, Nov. 23, 1993.

Scarne, Scarne's Encyclopedia of Games, Harper & Row, N.Y., Copyright 1973, pp. 33–41, 381, 383 and title pages.

Scarne, Scarne's New Complete Guide to Gambling, Simon & Schuster, N.Y., Copyright 1961, pp. 440–445 and title pages.

Scarne, Scarne's Encyclopedia of Card Games, Harper & Row, N.Y., Copyright 1983, pp. 299–304, 383, and titled pages.

W.S. Gibson, Hoyle's Modern Encyclopedia of Card Games, pp. 218–219, 369–370 (1974).

Casino Player, vol. IV, No. 12, Aug. 1993, "My Biggest Slot Jackpot", Stanford Wong.

Gaming Concepts, Inc. "Over/Under 13 Blackjack brochure", 1983.

Casino Journal, vol. 8, No. 12, Dec. 1992, "Working Within The Systems: IGT's linked progressive programs take leap to the tables", pp. 10–15, 40, 41.

Casino Gaming, Sep. 1988, "Aruba Deals A New Game: Caribbean Stud Poker", pp. 12–13.

Casino Journal, vol. 8, No. 6, Jun. 1993, "So You Wanna Be A Gambler", pp. 1, 5.

Information Disclosure Statement, Apr. 7, 1988, Describing "Sklansky's Casino Poker" and Video Poker.

Coin Hopper Model CH–500 and Model No. DH–750/U1 Literature Asahi Seiko.

26 Jan., 1993 Statement of Grounds and Particulars, By John Huxley Ltd., In Opposition to Australian in Opposition to Australian Patent Application No. 628044.
State of New Jersey Casino Control Commission PRW 217205 Civil Action, IGT's Second Amended Petition for Authorization for the Implementation of the Game of Progressive 21, filed sometime after Aug. 4, 1992.
Review Journal, "Gamblers Take Chance at Million Dollar Payoff", By C. J. Boyer.
Winning Gamer, Issue #17, Feb. 1986, Pi Yee Press, LaJolla, CA.
Scarne, Scarne's Encyclopedia of Games, "Hold 'Em", Harper & Row Publishers, Copyright 1973, pp. 14–18, 26.
Abercrombie & Fitch, Play Hours, 1960, p. 11, Blackjack Towel.
Scarne, Scarne's Encyclopedia of Card Games, copyright date unknown, p. 288.
Jim Kilby's Declaration Under 37 C.F.R. § 1.132.
TXU 184,603, Mar. 30, 1985.
TX 2,568,066, Mar. 6, 1989.
Scarne, Scarne's Guide to Modern Poker, copyright unknown, pp. 40, 60–61.
Request for Reexamination U.S. Patent No. 4,861,041; issued Aug. 29, 1989; Date of Service: Jun. 20, 1995.
Request for Reexamination, U.S. Patent No. 4,861,041; issued Aug. 29, 1989; Date of Service: Sep. 2, 1993.
Request for Reexamination U.S. Patent No. 5,288,077, issued Feb. 22, 1994; Date of Service May 26, 1995.
Request for Reexamination U.S. Patent No. 5,364,105, issued Nov. 15, 1994; Date of Service May 26, 1995.
Asahi Seiko Catalog No. AV89C, Aug. 20, 1989, pp. 44, 51 and Photograph "A".
Scarne, Scarne's Encyclopedia of Games, Copyright 1973, pp. 11, 31, 440–445.
Declaration of I. Nelson Rose, dated Jan. 26, 1989.
Declaration of Don Clark, dated Feb. 2, 1989.
Declaration of Dennis Robie, dated Jan. 27, 1989.
Declaration of Mark A. Sincox, dated Feb. 7, 1989.
Declaration of John Edward Roethel, dated Feb. 7, 1989.
Commerce Casino Brochure Re Wisted California Blackjack.
D&D Gaming Patents, Inc. v. Rio Properties, Inc., et al.; Case No. CV–S–93–235–LDG–RLH; Defendants JFA Enterprises, Inc.'s and John F. Acres' Supplemental Responses to Plaintiff's Interrogatories Nos. 11–20; As Requested by Feb. 28, 1994 Letter from Plaintiff's Counsel; Supplemental Response to Interrogatory No. 19.

APPARATUS FOR PLAYING A ROULETTE GAME INCLUDING A PROGRESSIVE JACKPOT

BACKGROUND OF THE INVENTION

1. Field of the Invention

The present invention relates to casino games, and more particularly pertains to a method and apparatus for playing a roulette game including a progressive jackpot and a bonus jackpot.

2. Description of the Prior Art

Roulette is a well-known casino game which has been played for many years. A typical conventional roulette game includes a table bearing a felt covering upon which indicia forming a betting layout has been silk-screened or otherwise imprinted. A typical roulette wheel includes a number ring bearing a circular array of numbered segments bearing numbers 1 through 36. In addition, the number ring typically includes the numbers 0 and 00 disposed at diametrically opposite locations on the number ring. The numbers 1 through 36 are not disposed in numerical order, but are typically disposed in a predetermined arrangement, such that roulette wheels located in different casinos will have the same standard predetermined number ring arrangement. The numbers disposed in a circular array in the number ring region of the wheel bear the alternating colors of red and black, with the exception of the 0 and 00 numbers, which are typically colored green. A ring of pockets corresponding in number to the plurality of numbers of the circular number ring lies adjacent, but radially inward of the number ring, on the typical roulette wheel. In addition, a typical roulette wheel includes a circular, inclined ball track, disposed above, and radially outwardly of the number ring.

In operation of a typical roulette game, players place chips or tokens on the betting layout located on the roulette table, and then the croupier or dealer spins the roulette wheel to place the ball in motion about the circular ball track. As the wheel slows, the ball moves radially inwardly and comes to rest in one of the pockets associated with a particular one of the numbers of the number ring. After the ball comes to rest in one of the pockets, the croupier or dealer settles the various wagers placed on the table layout in accordance with predetermined rules and wager odds.

In accordance with U.S. Pat. Nos. 4,861,041 and 5,078,405, both issued to Daniel A. Jones and James P. Suttle, and currently assigned to Progressive Games, Inc., a method and apparatus for including a progressive jackpot component in a live casino game is disclosed. The apparatus includes a plurality of coin acceptors disposed at player location of a casino card gaming table for use by players in placing a separate optional wager to participate in a progressive jackpot component.

U.S. Pat. No. 5,042,810, issued to Martin G. Williams on Aug. 27, 1991, and assigned to Technical Casinos Services, Ltd., discloses a method and apparatus for playing a roulette game including a progressive jackpot. The apparatus includes an optical reader which reads from the roulette wheel the number at which the ball comes to rest, and an electronic display which displays the last few winning numbers in black, red, and green columns. The apparatus includes a computer programmed to detect the occurrence of game situations appropriate to payout of two separate jackpots. An automatic chip counter and sorter counts the wagers placed on the layout and increments two separate jackpot amounts based upon percentages of the layout wagers. The first jackpot is paid when a number occurs three times in a row, and is paid to the player who is playing with the color against which that number is permanently allocated. For example, the numbers 1, 6, 14, and 18 are assigned to red; the numbers 2, 7, 15, and 19 are assigned to blue; and the numbers 3, 89, 20, and 30 are assigned to yellow; etc. The second jackpot them immediately becomes available to be won and is won if the same number occurs on the next spin. If no one is playing the color when the number occurs, then the jackpot is not won and the amount continues to be incremented on the jackpot display. Because each player plays with differently colored tokens, each player may bet on only a small portion of the number on the wheel and layout in order to be eligible to win the progressive jackpot.

SUMMARY OF THE INVENTION

The present invention provides an improved method and apparatus for playing a roulette game including a progressive jackpot which includes a plurality of coin acceptors to enable players to place an optional progressive jackpot wager. In operation, players place game wagers on a numbered layout imprinted on a table surface by using different colored chips assigned to each player. The apparatus includes a control system having an optical sensor head for detecting the speed and position of the ball in the roulette wheel, as well as the number of revolutions of the wheel. The control system displays on an electronic sign a progressive jackpot amount, winning numbers, and a random bonus jackpot. Players win the progressive jackpot by betting on the same winning number four times in a row. The electronic control system of the game, in conjunction with a dealer console, maintains an accounting of wagers placed, winning numbers, and amounts paid. The apparatus also includes a sound system for generating various sound effects at different stages of the game to enhance player excitement and appeal. A motorized chip conveyer assembly disposed beneath the table surface forms a chip return track underlying the coin acceptors for the purpose of returning chips or tokens placed as jackpot wagers to the dealer.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT(S)

Figure 4:
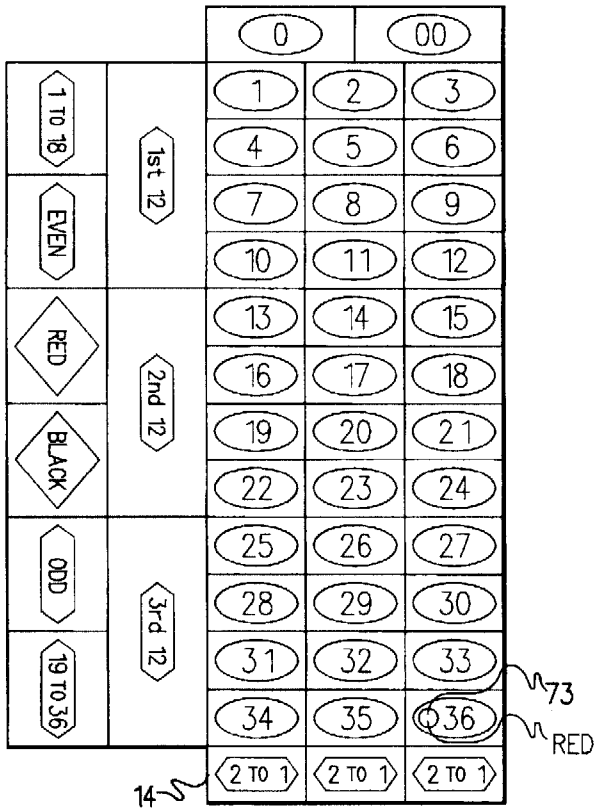
FIG. 4 is a top plan view illustrating the betting layout configuration of the apparatus for playing a roulette game including a progressive jackpot according to the present invention.

Referring now to the drawings, wherein like reference numerals designate corresponding structure throughout the views, and referring in particular to FIGS. 1 through 7, an apparatus 10 for playing a roulette game including a progressive jackpot according to a first preferred embodiment of the invention includes a table surface 12 including a concave peripheral edge portion 13 at which a croupier or dealer stands or sits during operation of the game. A betting layout 14 silk screened or otherwise imprinted on a felt covering disposed over the table surface 12 bears numbered indicia corresponding to the numbers appearing in a circular numbers ring of a conventional roulette wheel 28. The betting layout 14, illustrated in detail in FIG. 4 is conventional, and includes indicia representing the numbers 1 through 36, in addition to the numbers 0 and 00 and other indicia representative of various conventional roulette wagers and odds. In operation, a plurality of players, each assigned a different color of token or chip, place bets in a conventional manner by placing their particular colored chips, known as wheelchecks, on the indicia of the layout 14.

Figure 2:
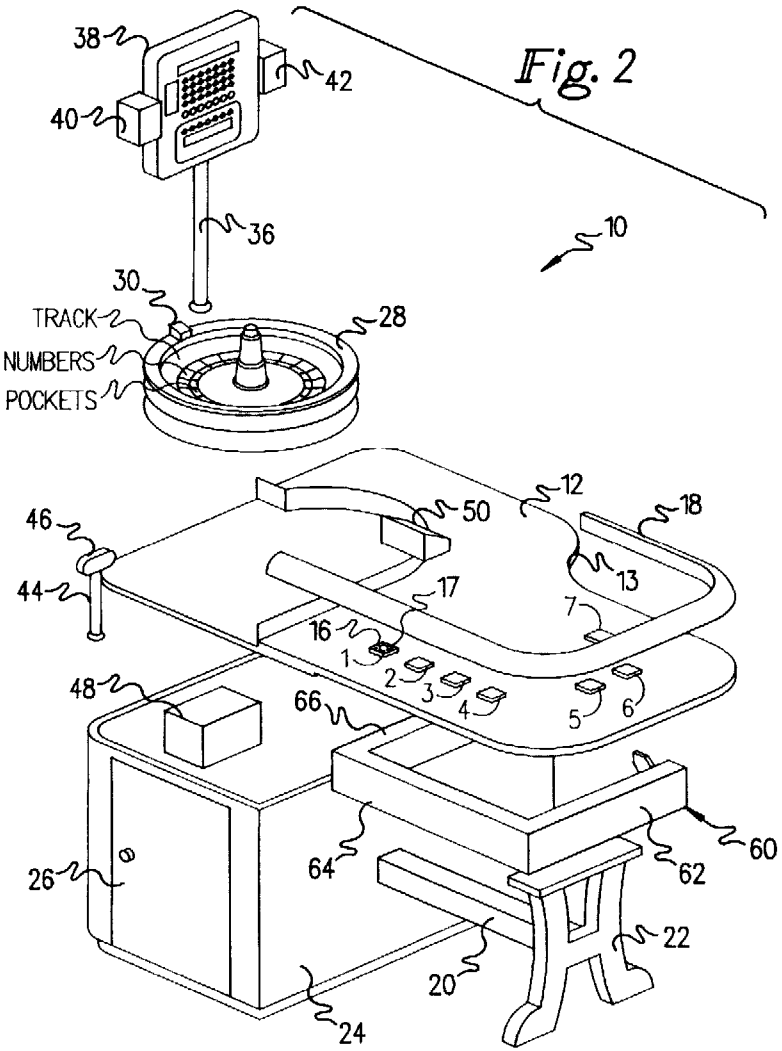
FIG. 2 is a an explode perspective view illustrating the apparatus for playing a roulette game including a progressive jackpot according to the present invention.
Figure 1:
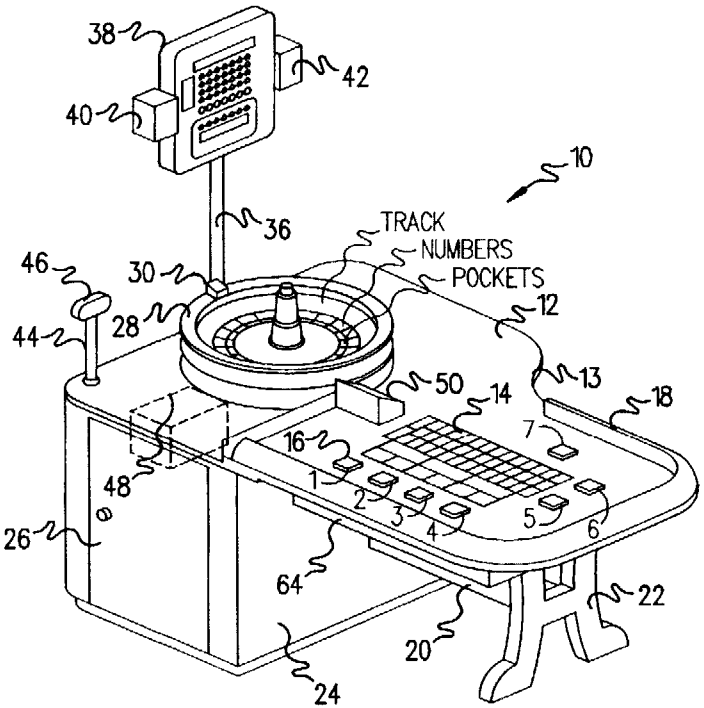
FIG. 1 is a perspective view of the apparatus for playing a roulette game including a progressive jackpot according to a preferred embodiment of the present invention.

In accordance with the present invention, as shown in FIGS. 1 and 2, a plurality of coin acceptors 16 disposed at player locations 1, 2, 3, 4, 5, 6, and 7 about the periphery of the table 12 enable players to place an optional progressive jackpot wager by inserting a chip or token into the player's acceptor 16. In accordance with a preferred embodiment of the invention, the coin acceptors 16 are preferably constructed in accordance with the disclosure of U.S. patent application Ser. No. 08/408,267, filed Mar. 20, 1995, and entitled Coin Acceptor Including Multi-State Visual Indicator, the entire disclosure of which is hereby incorporated by reference herein. The coin acceptor 16 preferably includes a plurality of lights 17 in addition to a pair of optical sensors for detecting wager placement and wager acceptance. In accordance with the present invention, the lights 17 preferably correspond in color to the wheelchecks assigned to the associated player location. As set forth in the aforementioned patent application, the coin acceptors include a transversely extending solenoid which maintains a wagered chip or token in a partially inserted orientation until such time as the solenoid receives a signal from an electronic controller to retract the solenoid, allowing the chip to drop past internal optical sensors and thus be registered as accepted for purposes of player participation in the progressive jackpot. The preferred coin acceptors have been utilized by Progressive Games, Inc. in connection with CARIBBEAN STUD® POKER gaming tables, and are available from Progressive Games, Inc. of Fort Lauderdale, Fla.

With further reference to FIGS. 1 and 2, the roulette wheel 28 includes a radially outer and uppermost TRACK region around which the ball initially travels when the dealer spins the wheel 28. As the wheel 28 slows down, the ball drops downwardly and inwardly from the TRACK, and ultimately comes to rest in one of a plurality of POCKETS disposed in a circular array radially inwardly of a circular ring of NUMBERS. The apparatus 10 of the present invention employs a sensor head 30 including four optical sensors. A prior art conventional optical reader head is available from Technical Casino Services, Ltd., of London, England, which includes three optical sensors, two for optically monitoring the numbers in the NUMBERS ring of the roulette wheel 28 and for monitoring the POCKETS in the roulette wheel 28, and a third sensor for detecting the disposition of the ball in one of the pockets. In accordance with the present invention, a fourth optical sensor is added to the sensor head 30 for monitoring movement of the ball in the upper and radially outer TRACK region of the wheel 28, for a purpose to be described hereinafter.

The apparatus of the present invention 10 also preferably includes a vertical standard 36 mounting an electronic jackpot display sign 38 above the table surface 12. A pair of speakers 40 and 42 disposed on opposite side faces of the sign 38 provide sound effects appropriate to different game conditions or stages during play of the game.

Figure 3:
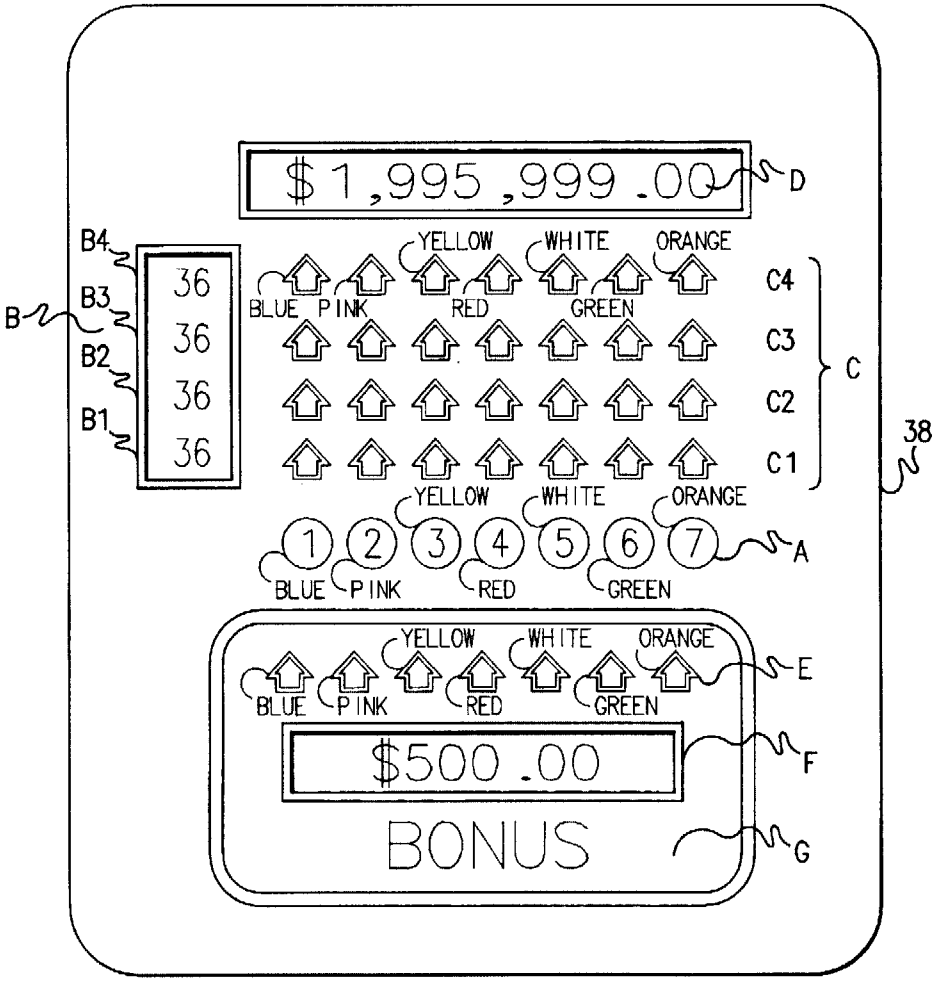
FIG. 3 is a front elevational view illustrating the jackpot display sign of the apparatus for playing a roulette game including a progressive jackpot according to the present invention.

With reference to FIG. 3, the sign 38 includes a row of indicator lights A corresponding to player positions 1 through 7 and respectively color-coded blue, pink, yellow, red, white, green, and orange for the purpose of indicating which players have placed a jackpot wager and are thus eligible to participate in the progressive jackpot and bonus jackpot components of the game. A display window region B of the sign 38 includes vertically spaced regions B1, B2, B3, and B4 for indicating the last four winning numbers determined by spins of the wheel 28. A rectangular array or grid formed by vertically spaced rows of arrows C1, C2, C3, and C4 serve, upon appropriate illumination, to indicate the progress of the different players toward winning a progressive jackpot amount displayed in an upper window or region D of the sign 38.

For example, with reference to FIGS. 3 and 4, if player number four had placed a wager on the number 36 on the layout 14 by placing a red token 73 on the appropriate numbered indicia, on four successive occasions, and if the roulette wheel 28 had been spun on four successive occasions with the ball landing in the pocket corresponding to the number 36 on each of the four successive occasions, then player number four would have won the progressive jackpot amount displayed in the window D. Also, the winning number display B would display the winning number 36 in each of position B1, B2, B3 and B4, as shown in FIG. 3. When the player number four placed a progressive jackpot wager by insertion of a token into his or her coin acceptor 16, the corresponding light A would illuminate. If the player won on the first spin of the wheel 28, the arrow above the player number four position on the sign 38 in the row C1 would be illuminated. Upon player number four's next winning wager and spin, the arrow in row C2 above indicator light No. 4 would illuminate, etc.

With further reference to FIGS. 1 and 2, the apparatus 10 according to the present invention also preferably includes a support leg assembly 22 connected by a horizontally extending support beam 20 to a housing portion 24 having a door 26 for access to an interior thereof. The apparatus 10 also preferably further includes a standard 44 mounting an electronic display sign 46 for purposes of displaying the last four winning numbers, in a manner conventional per se. In accordance with the present invention, the apparatus 10 also preferably includes an electronic controller 48 operably connected to a dealer console 50, and to other electronic components of the apparatus, in a manner to be described hereinafter.

Figure 5:
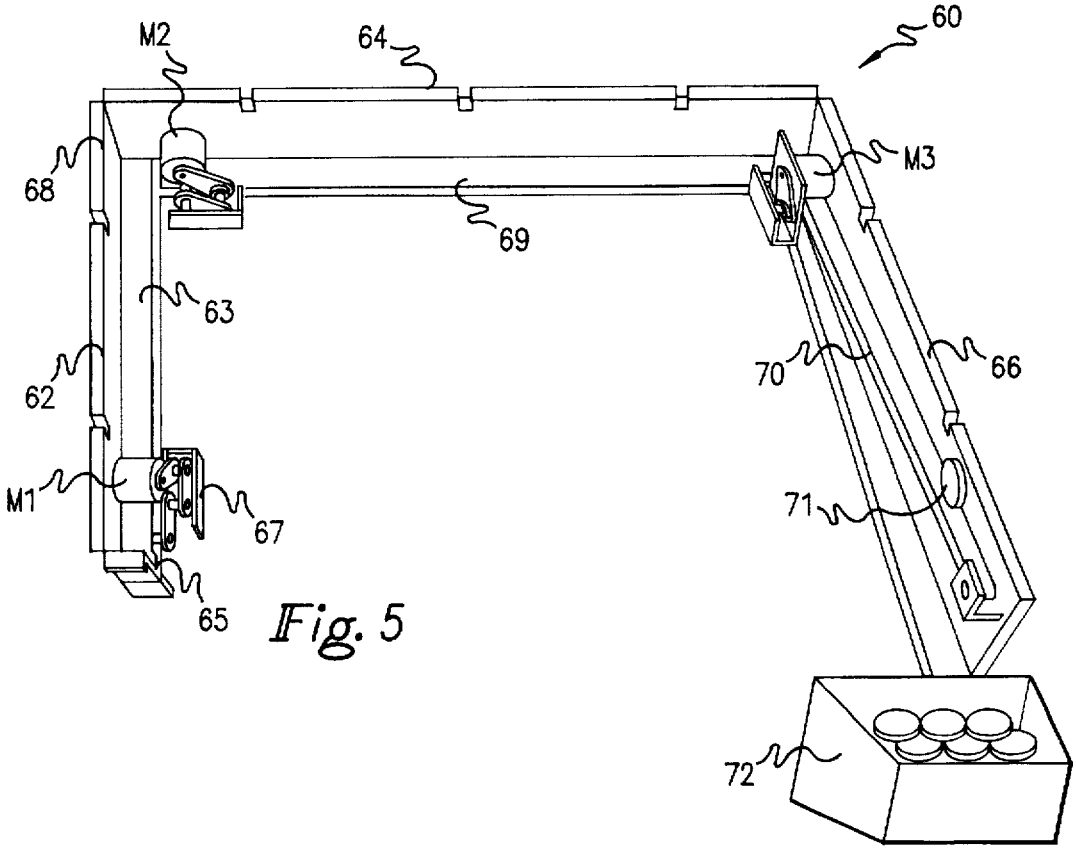
FIG. 5 is a perspective view illustrating the chip return conveyor assembly of the apparatus for playing a roulette game including a progressive jackpot according to the present invention.

With reference to FIGS. 2 and 5, the apparatus 10 and according to the preferred embodiment of the present invention also preferably includes a chip return conveyor assembly 60 for the purpose of collecting and returning progressive jackpot wagers placed by insertion of chips or tokens into the coin acceptors 16 disposed at player locations 1 through 7 on the table surface 12. After retraction of a solenoid rod associated with each of the coin acceptors 16, the inserted chips fall through the table surface 12 into a rectangular channel shaped trough or conveyor assembly 60 including leg portion 62, 64, and 66.

With reference to FIG. 5, the chip return conveyor assembly 60 includes a first endless fabric loop or belt conveyor 63 disposed within the first leg portion 62 for movement around a drive spindle 65 and an idler spindle 68. A first motor M1 drives the conveyor belt 63 by rotating the drive spindle 65 through a belt and pulley assembly 67. In a similar manner, a second motor M2 drives a conveyor belt 69 disposed within the second leg portion 64, while a third motor M3 drives a third conveyor belt 70 disposed within the third leg portion 66 of the chip conveyor assembly 60. In operation, a coin or token which passes as a progressive jackpot wager through one of the coin acceptors 16 disposed at the seven player locations spaced about the table surface 12 will fall onto one of the conveyor belts 63, 69, or 70. For example, with reference to FIG. 2, assume that a player at player location 5 placed a progressive jackpot wager, which would then fall into the leg 62 of the conveyor assembly 60 and onto the belt 63. The coin or chip 71 would then travel along the first conveyor belt 63 until it fell off the end of the conveyor belt 63 at a discharge end disposed opposite the motor M1 onto an inlet end of the second conveyor belt 69 disposed adjacent the motor M2. The chip 71 would then travel along the second conveyor belt 69 until it fell off onto an inlet end of the third conveyor belt 70 disposed adjacent the motor M3. Whereupon the chip 71 would travel along the third conveyor belt 70 until it fell off a discharge end of the conveyor belt 70 and into a box or other receptacle 72 preferably disposed adjacent the dealer location 13 of the table 12 shown in FIG. 2. In this regard, it should be noted that the discharge end of the conveyor belt 63 is disposed at an elevation above the inlet end of the conveyor belt 69. The second conveyor belt 69 similarly possesses a discharge end portion disposed at an elevation above the inlet end of the third conveyor belt 70. In this manner, the progressive jackpot chips or tokens fall successively from conveyor belt to conveyor belt, and ultimately into the receptacle 72.

Figure 7:
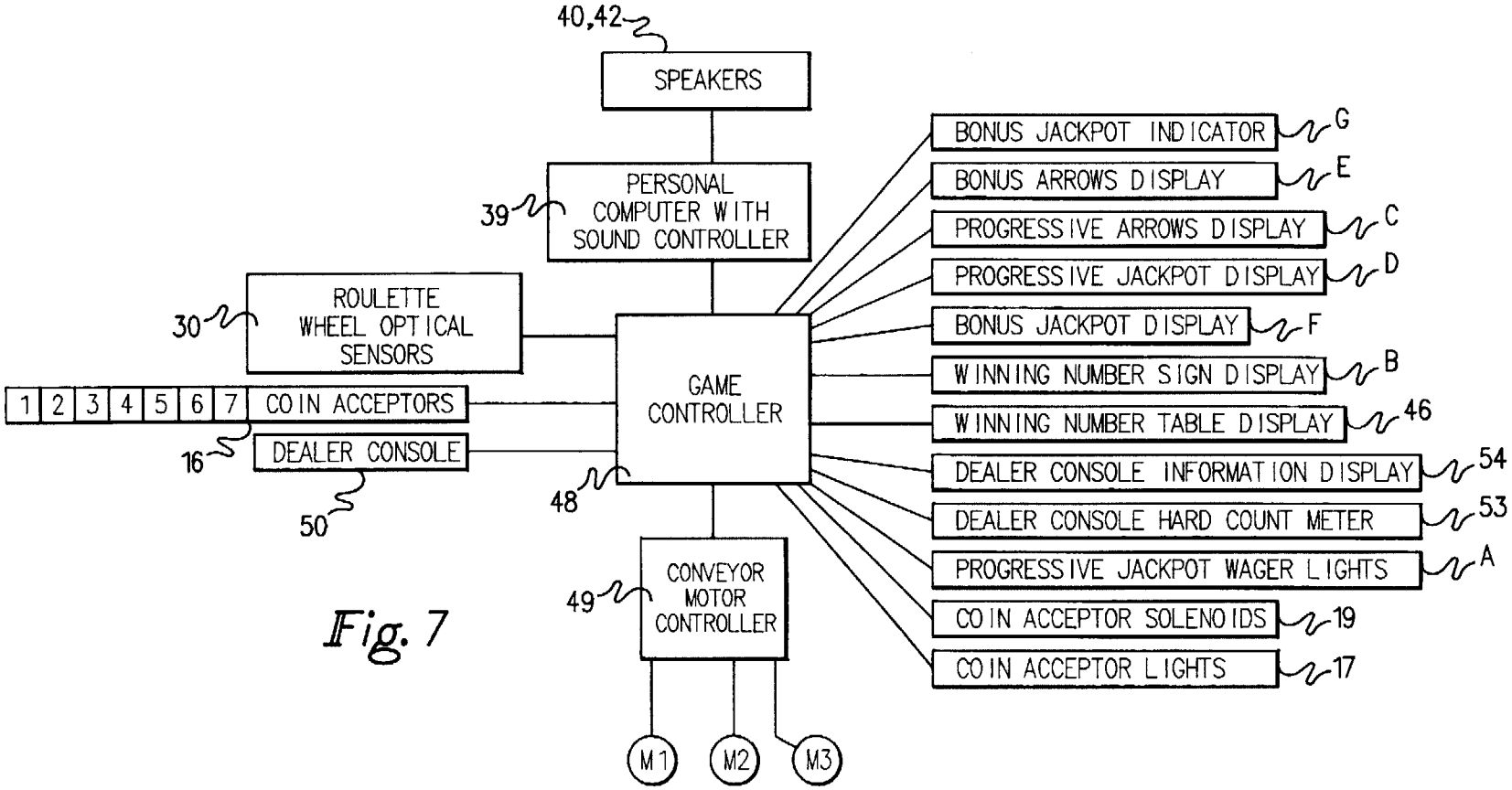
FIG. 7 is a block diagram illustrating the electronic components of the apparatus for playing a roulette game including a progressive jackpot according to the present invention.

The game controller 48 is preferably connected to the motors M1, M2, and M3 through a conveyor motor controller circuit 49, as shown in FIG. 7. The game controller 48 also receives input signals from each of the seven coin acceptors 16 which indicate placement of a coin or token by a player for participation in the progressive jackpot. In order to avoid unnecessary wear and excess noise, the game controller 48, in conjunction with the conveyor motor controller 49, preferably only energizes the motors M1, M2, and M3 if and when required, and for as short a duration as is actually required for effective transport of chips or tokens from one conveyor to the next. For example, if a player at position 1 shown in FIG. 2 placed a jackpot wager into the coin acceptor 16, only the motor M3 need be energized to transport the chip 71 along-the conveyor belt 70 to the receptacle 72. Similarly, if a player at position 6 placed a progressive jackpot wager by inserting a chip or token into the acceptor 16, the chip would initially fall onto the conveyor 63, and motors M1, M2, and M3 would be turned on in succession to transport the chip to the receptacle 72. Alternatively, the conveyor motors may operate continuously or for a predetermined time interval following either manual or automatic activation of a reset switch dependent upon game conditions. The table and conveyor configuration may be constructed in either left or right handed versions depending upon the preferences of the casino and dealer.

Figure 6:
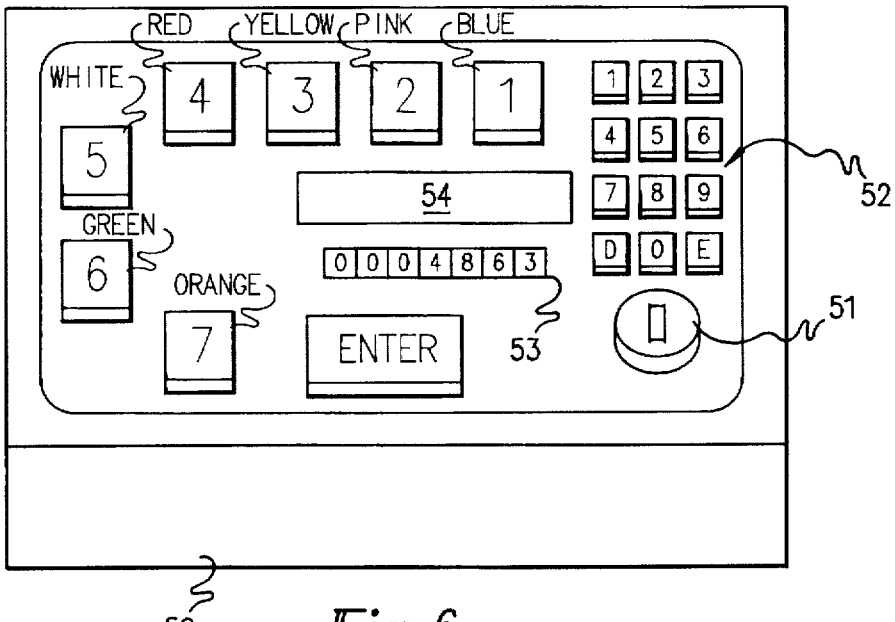
FIG. 6 is a front perspective view illustrating the dealer control console of the apparatus for playing a roulette game including a progressive jackpot according to the present invention.

The dealer control input console 50 illustrated in FIG. 6 includes a number keypad 52 bearing separate keys denominated with the indicia 0 through 9, in addition to a delete key bearing the letter D, and an enter key designated by the indicia E. The keypad 52 may be employed for data entry, including the correction of an errantly automatically detected winning number. The dealer console 50 also includes color key set comprising a plurality of player buttons designated 1 through 7 corresponding to the seven player positions on the table surface 12. The player buttons 1 through 7 on the dealer console 50 are color-coded blue, pink, yellow, red, white, green, and orange respectively, in correspondence with the color coding on the indicator lights A on the jackpot sign 38 (FIG. 3), the differently color coded chips assigned to the players for placement of wagers on the layout 14, the arrows disposed in region C on the sign 38, and the arrows disposed in region E on the sign 38. The dealer console 50 also includes an ENTER key for confirming a control input entry by the dealer, a LED or LCD information display 54 for displaying various game information messages, and a hard count odometer type meter 53 for maintaining a running count of the total number of progressive jackpot wagers placed into the coin acceptor 16. The ENTER key may also optionally function as a reset switch to manually reset the apparatus for the next game. The ENTER key may also flash or blink upon detection of a ball in a pocket to signal a need for dealer input. The information display window 54 is preferably operative to display message to the dealer including jackpot messages, communication status, coin slot communication status, jackpot amount, and service mode messages. The ENTER key preferably includes an interior LED or lamp which illuminates at appropriate times to indicate a requirement for a dealer action or control input.

While the method of play of a roulette game including a progressive jackpot according to the present invention may be implemented manually, the apparatus 10 preferably includes an electronic control system illustrated in box diagram form in FIG. 7. The control system preferably includes a game controller 48 which may comprise one or more microprocessors and associated circuitry for performing control functions pursuant to sensor and dealer inputs and program control instructions, for example of the type scored on ROM memory chips. A personal computer 39 operatively interfaced with the game controller 48 includes a conventional sound controller card operably connected for driving speakers 40 and 42. A suitable personal computer for use with the present invention comprises a 386SX or better class personal computer including a CD-ROM drive and a SoundBlaster AWE-32 sound card. The personal computer preferably includes suitable software, for example in CD-ROM format, for producing various desired sound effects at different stages of the game. Sound effects can include verbal messages, start of game, announcement of jackpots, call pit boss, music, and other sound effects. In addition to announcing game conditions and jackpot amounts, the sound effect system can also include player attract messages to enhance player interest in participation in both the underlying game and the progressive and bonus jackpot components of the game.

In addition to the production of sound effects, the personal computer 39 in conjunction with appropriate software can also be utilized to provide an accounting and reporting system with respect to progressive jackpot wagers placed and won. For example, game management software similar to that available from Progressive Games, Inc. of Ft. Lauderdale, Fla. and utilized in connection with the play of CARIBBEAN STUD® poker including a progressive jackpot feature can be employed. This is particularly desirable where only a portion of the progressive jackpot wagers are allocated to the progressive jackpot display amount D, with the remaining portion allocated to the game provider or the house or casino.

The game control 48, in connection with generally conventional LCD sign control circuitry, is operational under appropriate control inputs and program control instructions to cause information displays regarding game condition to be displayed on display portions A, B, C, D, E, F, and G of the jackpot sign 38, and also on the winning number table display 46, the dealer console information display 54, and the dealer console hard count meter 53. In addition, the game controller 48 is operative to provide suitable control signals, through associated driver circuitry, to selectively energize and thus retract the coin acceptor solenoids 19, and also to control the illumination of the coin acceptor lights 17. Preferred information displays of the sign 38 include progressive jackpot wager lights A for indicating which players have placed a wager in their associated coin acceptor 16 to participate in the progressive jackpot. The sign 38 also preferably includes a winning number sign display B for the purpose of indicating winning numbers determined through spin of the roulette wheel 38. The game controller 48 also drives, through LCD sign driver circuitry, a progressive arrows display C for indicating through the sequential illumination of color-coded arrows, the progress of each player in connection with efforts to win the progressive jackpot. The game controller 48 is also operative to display the current progressive jackpot amount in the progressive jackpot display portion D of the sign 38. In this regard, the game controller 48, in conjunction with the personal computer 38, can include appropriate control instructions to divide or allocate each chip inserted into a coin acceptor 16 between a plurality of separate "accounts". Example accounts include the progressive jackpot D, the bonus jackpot display F, an account representing the house or casino profit, an account to reseed the jackpot after a win, and an account representing a fee provided to the distributor of the game.

The game controller 48 is also operative to illuminate a bonus jackpot indicator G on the sign 38, dependent upon either random or predetermined conditions for activation of player eligibility for the bonus jackpot. The predetermined conditions for activation of the bonus jackpot may include either random, pseudo-random, or algorithm determined activation conditions. For example, possible random conditions include activation of the bonus jackpot on a game subsequent to detection of a certain predetermined winning number by the roulette wheel sensors 30, detection of a predetermined number of spins of the roulette wheel 28 prior to disposition of the ball in a pocket, the detection of a predetermined number of rotations of the roulette ball about the TRACK portion of the roulette wheel 28, the detection of a predetermined speed of rotation of the ball, or other conditions of the roulette wheel 28 or ball as determined by the sensors 30. Examples pseudo-random bonus jackpot activation conditions include the generation of a pseudo-random number by the game controller 48. Various formula algorithms may also be employed to determine conditions for initiation of the bonus jackpot, such as a formula based upon the amount of progressive jackpot wagers placed into the coin acceptors 16, the number of games or spins of the roulette wheel 28, the passage of a predetermined time period, the passage of a predetermined number of turns since any player has won a jackpot, etc.

The game controller 48, is also operative to select a winning player color for the bonus jackpot, and to display the winning player color on the bonus arrows display E portion of the jackpot sign 38. As in the case of the bonus jackpot activation condition, the winning player color can also be determined by the game controller 48 by a variety of random, pseudo-random, or algorithm methods, without departing from the scope of the present invention.

The bonus jackpot amount displayed in the bonus jackpot display F of the sign 38 may be calculated in a variety of different manners. For example, a predetermined portion of each progressive jackpot wager placed into the acceptors 16 may be allocated to the bonus jackpot. Alternatively, the bonus jackpot amount may increment by a certain amount per turn, per time period, or based upon wagers placed on the layout 14. Preferably, the bonus jackpot amount selected for display is rounded to $25.00 increments. For example, the bonus jackpot amount may be rounded to $25.00, $50.00, $75.00, or $100.00, depending upon the accumulated increment. As an alternative to incremental determination of the bonus jackpot amount, the bonus jackpot amount may be randomly determined, randomly selected from a predetermined number of possible bonus jackpot amounts, or randomly determined within a predetermined bonus jackpot amount range.

In accordance with a particularly preferred aspect of the present invention, the game controller 48 is operative, in conjunction with the roulette wheel sensors 30, the coin acceptors 16, and the coin acceptor solenoids 19 to implement a lockout feature to accept currently placed progressive jackpot wagers, and to preclude late jackpot wagers, after a certain point has been reached in the play of a game. For example, in the preferred embodiment of the invention, the game controller 48 sends a signal to retract the coin acceptor solenoids 19 upon detection of four revolutions of the ball in the TRACK of the roulette wheel 28. Optionally, the sensors may instead detect a drop of speed of the ball by a predetermined percentage, or to a predetermined level. After retraction of the coin acceptor solenoids 19, the wagers placed into the coin acceptors 16 fall past optical detectors associated with the coin acceptors, causing registration of the progressive jackpot wagers as placed by the game controller 48, along with appropriate updating of the jackpot display signage and jackpot accounting software. The coin acceptor solenoids 19 are then deenergized, and allowed to extend under spring bias to again block passage of additional chips through the acceptors 16, thus preventing late wagering. The game controller 48 may also operate to deactivate the optical sensors within the coin acceptors 16 to lockout and preclude registration of late wagers in the event of solenoid failure. Preferably, the game controller 48 also includes an automatic reset function to reset the apparatus for the next game after a predetermined number of revolutions of the wheel 28, with the ball disposed in a pocket. Thus, in this condition, the winning number has already been determined, and the apparatus may be automatically reset for the next game. As may be readily appreciated, the automatic lockout and reset features obviate the need for lockout and reset buttons on the dealer console, 50, and thus reduce the burden on the dealer and minimize the potential for human error. The lockout and reset functions may be optionally manually activated by the dealer pressing one or more buttons on the console 50.

The game controller 48 also preferably implements game informational status and diagnostic functions operative to tests and insure proper operation of the various components of the electronic control system.

A description of the preferred method of playing a roulette game including a progress jackpot according to the present invention utilizing the apparatus follows.

Method Of Play

The apparatus 10 illustrated in FIGS. 1 and 2 permits a maximum seven player game. In addition to the apparatus 10, the preferred method employs a plurality of different types of chips including seven regular wheelcheck colors plus one ante-bet chip for insertion into the acceptors 16 to enable players to participate in both the progressive jackpot, and the random bonus prize.

Although in the illustrated currently preferred embodiment of the invention 10, each of the player positions 1 through 7 represents a different color, in an alternative embodiment of the invention, each player position may be selectively assigned to any one of a plurality of available colors.

The game of roulette in accordance with the present invention is played in the conventional manner, but with the following additions and alternative options:

Progressive Jackpot

In order to win the progressive jackpot, a player must bet on the same winning number a predetermined number of times successively, preferably at least three times consecutively. The actual number of times is an option. The present invention may optionally employ two separate progressive jackpots, one for three consecutive winning numbers, and another for four consecutive winning numbers. For example, to generate a larger progressive prize, the rules of the game can be modified so that a player must hit the same winning number four or five times consecutively. This would obviously make the progressive jackpot prize harder to win, and thus also larger. The progressive prize is only payable to those players that have placed a progressive jackpot wager into one of the acceptors 16 before the start of each game. The following example assumes that four consecutive numbers are required to win the progressive jackpot D.

In order to determine which players are eligible to win the progressive jackpot, the following events will occur:

1. As soon as a player has placed a progressive jackpot wager, the coin acceptor 16 in front of the player on the table will illuminate.
2. Simultaneously, position A of the corresponding color and player number will automatically light up on the jackpot sign 38, indicating that the player is eligible for the progressive jackpot D and the bonus prize F.
3. The player next places his or her bets on the layout 14, just as in a conventional game of roulette.
4. The dealer then spins the wheel 28.
5. The lock-out feature causes the solenoids of the active acceptors 16 to momentarily retract and then immediately extend, dropping all progressive jackpot wagers into the return conveyor assembly 60 and automatically locking out further wagers after four revolutions of the ball in the TRACK of the wheel 28 past the sensor head 30, ensuring that no player can place a progressive jackpot wager after the result of the spin is known, or after the ball slows to a large extent, thus enhancing security of the game.
6. The ball then falls into one of the pockets of the wheel 28 and the dealer places a marker on the corresponding number on the layout 14, as in conventional roulette.
7. If there are any wheel checks (color coded chips) on the winning number, the dealer then enters the one or more winning colors onto the color key set of the console 50 by depressing one or more of the colored buttons 1 through 7 and then the ENTER key. The console 50 can be situated next to the roulette wheel 28 in a fixed position, or can be moveable and placed next to the winning wheel checks after each spin. The key set consists of the seven colored buttons, representing the seven different wheel check colors, which, when depressed preferably illuminate. In an alternative embodiment, the console 50 includes provisions for entry of not only the color of winning chips present on the layout 14, but also for entry of how many winning chips of each color are present.
8. Immediately upon dealer entry, this information is entered into the game controller 48 and displayed on the jackpot sign 38 in the following manner:
9. If a player has bet on the winning number, the number will be displayed on the Winning Number section B of the sign 38 in position B1. Position B1 represents the most recent winning number.
10. Simultaneously, position C1 of the respective color of the progressive jackpot arrow panel C will illuminate, indicating that the player has completed stage one of the four stages needed to win the progressive jackpot. If a player has selected the winning number, but has not placed a progressive jackpot wager position C1 of the respective color of the progressive jackpot arrow panel C will not illuminate.
11. The dealer then makes the relevant payoffs, as in conventional roulette, and a new game begins.
12. The above process is repeated, and if the ball falls in the same number pocket as the previous spin:
13. If the player has bet on the same winning number again, the number will be displayed on the Winning Number section B of the sign 38 in position B2. Position B2 now represents the most recent winning number, and will only appear in this position if the previous winning number was exactly the same. If the last winning number was different from the previous winning number, this new number will simply replace the previous one in position B1.
14. Simultaneously, position C2 of the respective color of the progressive jackpot arrow panel C will illuminate, indicating that the player has completed stage two of the four stages needed to win the progressive jackpot. If a player has placed a layout wager on the winning number, but has not placed a progressive jackpot wager into an acceptor 16, position C2 of the respective color of the progressive jackpot arrow panel C will not illuminate. At this stage, an audible sound effect will be generated through the speakers 40, 42 to create excitement, and to indicate that the player now needs to bet on the same winning number only twice more, on the next two consecutive spins, in order to win the progressive jackpot D.

15. The dealer then makes the relevant payoffs, as in conventional roulette, and a new game begins.

16. The above process is repeated, and if the ball falls in the same number pocket as the previous spin (i.e., the same winning number has now occurred three consecutive times):

17. If the player has bet on the same winning number again, the number will be displayed on the Winning Number section B of the sign 38 in position B3. Position B3 now represents the most recent winning number, and will only appear in this position if the previous winning number was exactly the same.

18. Simultaneously, position C3 of the respective color of the progressive jackpot arrow panel C will illuminate, indicating that the player has completed stage three of the four stages needed to win the progressive jackpot. If a player has placed a layout wager on the winning number, but has not placed a progressive jackpot wager into an acceptor 16, position C3 of the respective color of the progressive jackpot arrow panel C will not illuminate. At this stage, another audible sound effect will be generated through the speakers 40, 42 to create excitement, and indicate that the player now needs to bet on the same winning number only once more, on the next spin, in order to win the progressive jackpot D.

19. The dealer then makes the relevant payoffs, as in conventional roulette, and a new game begins.

20. The above process is repeated, and if the ball falls in the same number pocket as the previous spin (i.e., the same winning number has now occurred four consecutive times):

21. If the player has selected the same winning number again, the number will be displayed on the Winning Number section B of the sign 38 in position B4. Position B4 now represents the most recent winning number, and will only appear in this position if the previous winning number was exactly the same.

22. Simultaneously, position C4 of the respective color of the progressive jackpot arrow panel C will illuminate. Positions C1, C2, C3, and C4 will now all be illuminated, indicating that the player has won the progressive jackpot D. At this stage, another audible sound effect will be generated through the speakers 40, 42 to indicate that the jackpot has been won. It is possible that more than one player can win the jackpot, in which case the prize is shared.

Alternatively, the progressive jackpot D might be won by achieving only three (instead of four) consecutive identical winning numbers. In this alternative embodiment positions B1 and C1 on the sign 38 would be blacked out at the start of the game.

Bonus Prize

The bonus prize is preferably only payable to those players that have placed a progress jackpot wager in the acceptors 16 before the start of the game in which the bonus prize feature is activated. The bonus prize feature is preferably activated only during randomly selected games, and preferably can only be won by one player at a time.

In accordance with the preferred embodiment of the invention, in order for a player to win the bonus prize, the following events must occur:

1. As soon as a player has placed a progressive jackpot wager, the lights 17 on the coin acceptor 16 in front of the player will illuminate.
2. Simultaneously, position A of the corresponding color column will automatically light up on the sign 38.
3. The player will then place his or her bets on the layout 14, just as in a conventional game of roulette.
4. The dealer then spins the wheel 28.
5. The lock-out feature causes the solenoids of the active acceptors 16 to momentarily retract and then immediately extend, dropping all progressive jackpot wagers into the return conveyor assembly 60 and automatically locking out further wagers after four revolutions of the ball in the TRACK of the wheel 28 past the sensor head 30, ensuring that no player can place a progressive jackpot wager after the result of the spin is known, of after the ball shows to a large extent, thus enhancing security of the game.
6. While the ball is still in spin, an audible sound effect will be generated through the speakers 40, 42, indicating that the bonus feature is in operation. This will only happen during games selected by the control system as eligible for the bonus prize.
7. Simultaneously, the BONUS panel or light G on the sign 38 will flash rapidly, indicating that the bonus feature is active for this game.
8. After a few seconds, one of the color-coded arrows in region E of the Bonus section of the sign 38 will illuminate, indicating the color that has been selected by the control system as the winning color.
9. Simultaneously, the dollar amount of the Bonus prize will be displayed on the Bonus Prize display F on the sign 38.
10. After the ball falls into a pocket on the wheel 28, the dealer places a marker on the corresponding number on the layout 14, as in conventional roulette.
11. If there are any wheel checks (color coded chips) on this winning number, the dealer then enters the winning colors onto the color key set of the console 50.
12. If any player's wheel checks match the color at position E on the Bonus section and the player bet on the winning number on the layout 14, the player wins the amount displayed on the Bonus Prize display F of the sign 38. At this moment, another audible sound effect will be generated through the speakers 40, 42.

In an alternative embodiment, the player wins a Bonus Prize based upon an amount per chip bet on the winning number on the layout 14. For example, if:

a) the Bonus Prize section E of the sign 38 indicates blue as the winning color for the Bonus Prize F, b) the ball falls into pocket number 17, c) the Bonus Prize amount selected and displayed in display F of the sign 38 is $20, and d) the player using blue chips has bet six chips on number 17, this player would now be paid a Bonus Prize of $120 determined by the calculation ($20×6).

The Bonus Prize F is in addition to whatever the player wins on the layout 14.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

We claim:

1. A roulette game including a jackpot, comprising:

a roulette wheel;

at least one sensor monitoring a condition of said roulette wheel;

a table including a plurality of player locations;

a betting layout on said table;

a plurality of coin acceptors at said player locations for placement of wagers by players to participate in said jackpot; a control system operatively connected to said sensor and said coin acceptors to control acceptance of wagers by said coin acceptors dependent upon a sensed condition of said roulette wheel by said sensor;

a sound system operatively connected to said control system for producing sound effects dependent upon a condition of play of the roulette game;

a motorized conveyor operatively connected to said control system for collecting coins, chips, or tokens placed into said coin acceptors;

a plurality of differently color-coded tokens corresponding to said player locations to distinguish wagers made by different players on said betting layout;

a sign including a color-coded display corresponding to said differently color-coded tokens for displaying jackpot information; and a dealer console including input controls color-coded in correspondence with said differently color-coded tokens for entering jackpot information for display on said sign.

2. A roulette game including a jackpot, comprising:

a roulette wheel;

a table including a plurality of player locations;

a betting layout on said table;

a plurality of coin acceptors at said player locations for placement of wagers by players to participate in said jackpot; and a motorized conveyor operatively connected to said control system for collecting coins chips, or tokens placed into said coin acceptors.

3. The roulette game of claim 2, further comprising at least one sensor monitoring a condition of said roulette wheel.

4. The roulette game of claim 3, further comprising a control system operatively connected to said sensor and said coin acceptors to control acceptance of wagers by said coin acceptors dependent upon a sensed condition of said roulette wheel by said sensor.

5. The roulette game of claim 2, further comprising a sound system operatively connected to said control system for producing sound effects dependent upon a condition of play of the roulette game.

6. The roulette game of claim 2, further comprising a plurality of differently color-coded tokens corresponding to said player locations to distinguish wagers made by different players on said betting layout.

7. The roulette game of claim 6, further comprising a sign including a color-coded display corresponding to said differently color-coded tokens for displaying jackpot information.

8. The roulette game of claim 7, further comprising a dealer console including input controls color-coded in correspondence with said differently color-coded tokens for entering jackpot information for display on said sign.

* * * * *